US007937976B2

(12) United States Patent
Huang et al.

(10) Patent No.: US 7,937,976 B2
(45) **Date of Patent: *May 10, 2011**

(54) REKEYABLE LOCK CYLINDER AND OPERATING METHOD THEREOF

(75) Inventors: Chao-Ming Huang, Kaohsiung County (TW); Chi-Ming Chen, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 85 days.

This patent is subject to a terminal disclaimer.

(21) Appl. No.: 12/432,201

(22) Filed: Apr. 29, 2009

(65) Prior Publication Data

US 2009/0277233 A1 Nov. 12, 2009

Related U.S. Application Data

(63) Continuation-in-part of application No. 12/149,757, filed on May 7, 2008, now Pat. No. 7,624,606.

(51) Int. Cl.
*E05B 27/04* (2006.01)
*E05B 29/06* (2006.01)

(52) U.S. Cl. ..... 70/338; 70/340; 70/368; 70/383; 70/384; 70/492; 70/493; 70/495

(58) Field of Classification Search ..... 70/337–343, 70/368, 382–385, 492–496
See application file for complete search history.

(56) References Cited

U.S. PATENT DOCUMENTS

| | | | | |
|---|---|---|---|---|
| 3,589,153 | A * | 6/1971 | Hill | 70/384 |
| 4,376,382 | A * | 3/1983 | Raymond et al. | 70/338 |
| 4,966,021 | A * | 10/1990 | Boag | 70/383 |
| 6,041,631 | A * | 3/2000 | Vonlanthen | 70/492 |
| 6,119,495 | A * | 9/2000 | Loreti | 70/340 |
| 6,860,131 | B2 | 3/2005 | Armstrong et al. | |
| 7,007,528 | B2 * | 3/2006 | Chong et al. | 70/492 |
| 7,424,815 | B1 * | 9/2008 | Pagnoncelli | 70/340 |
| 7,448,239 | B1 * | 11/2008 | Huang et al. | 70/360 |
| 7,448,240 | B1 * | 11/2008 | Huang et al. | 70/492 |
| 7,526,935 | B2 * | 5/2009 | Huang et al. | 70/360 |
| 7,624,606 | B1 * | 12/2009 | Huang et al. | 70/338 |
| 7,628,048 | B2 * | 12/2009 | Huang et al. | 70/338 |
| 2003/0089149 | A1 * | 5/2003 | Suzuki et al. | 70/492 |
| 2006/0101880 | A1 * | 5/2006 | Ward-Dolkas et al. | 70/492 |
| 2008/0264127 | A1 * | 10/2008 | Chiang et al. | 70/492 |

FOREIGN PATENT DOCUMENTS

JP 7197705 * 8/1995

* cited by examiner

*Primary Examiner* — Lloyd A Gall
(74) *Attorney, Agent, or Firm* — Muncy, Geissler, Olds & Lowe, PLLC

(57) ABSTRACT

A rekeyable lock cylinder comprises a cylinder body and a plug assembly disposed within the cylinder body. The plug assembly comprises a plug body, a plurality of assembled pins and a position block. The plug body has a longitudinal axis, a transverse axis vertical to the longitudinal axis, a keyhole and a first through hole. Each of the assembled pins is movably disposed in the plug body and comprises a first rack component and a second rack component selectively engaging with the first rack component. The position block disposed at the plug body has a plurality of pin runners used for disposing the first rack components, a second through hole corresponding to the first through hole and a tool-contacting surface located within the second through hole. The position block can move along the transverse axis-direction of the plug body to make each of the first rack components reengage with each of the second rack components.

17 Claims, 15 Drawing Sheets

REKEYABLE LOCK CYLINDER AND OPERATING METHOD THEREOF

This application is a Continuation-in-Part of application Ser. No. 12/149,757, filed on 7 May 2008, now U.S. Pat. No. 7,624,606 and for which priority is claimed under 35 U.S.C. §120; the entire contents of which are hereby incorporated by reference.

FIELD OF THE INVENTION

The present invention relates to a lock cylinder, more particularly to a rekeyable lock cylinder and operating method thereof with reinforced burglarproof.

BACKGROUND OF THE INVENTION

It is almost required to release mutual engagement of racks at first during rekeying process of known rekeyable lock cylinder and reengage racks after rekeying, such as U.S. Pat. No. 6,860,131 "rekeying a lock assembly" discloses a simple tool used for pushing linkage mechanism within a lock to rekey. However, linkage mechanism of the foregoing lock cylinder lacks burglarproof in design when rekeying as well as the simple tool is easy to obtain, that might be subject to unauthorized rekeying operation resulting in security problem.

SUMMARY OF THE INVENTION

It is an object of the present invention to provide a rekeyable lock cylinder and operating method thereof. First, a first matched key is inserted into a keyhole of a plug body and turning the first matched key to drive the plug body and a position block rotating. Next, a programming tool is inserted into a first through hole of the plug body and a second through hole of the position block. Next, the programming tool is turned to push against a tool-contacting surface of the position block and make each of the first rack components move along the transverse axis-direction of the plug body to release engagement with each of the second rack components. Next, the first matched key is pulled out before inserting a second matched key into the keyhole. Finally, the programming tool is turned to reengage the first and second rack components thereby completing overall rekeying process. According to the present invention, the programming tool can contact against the tool-contacting surface of the position block during turning process to push against the position block and drive the first rack components releasing engagement with the second rack components. On the contrary, if the used tool cannot contact against the tool-contacting surface during turning process, the position block cannot be moved to rekey, therefore, the present invent has efficiency of enhancing burglarproof of the rekeyable lock cylinder.

A rekeyable lock cylinder according to the present invention comprises a cylinder body and a plug assembly, and the plug assembly comprises a plug body, a plurality of assembled pins and a position block. The plug body has a longitudinal axis, a transverse axis vertical to the longitudinal axis, a keyhole and a first through hole. Each of the assembled pins is movably disposed in the plug body comprising a first rack component and a second rack component selectively engaging with the first rack component. The position block is disposed at the plug body having a plurality of pin runners used for disposing the first rack components, a second through hole corresponding to the first through hole and a tool-contacting surface located within the second through hole. The position block can move along the transverse axis-direction of the plug body to release engagement of the first and second rack components.

Operating method of a rekeyable lock cylinder according to the present invention comprising several steps will be described as follows. Step 1 is to provide a rekeyable lock cylinder, which at least comprises a plug body, a position block disposed at the plug body and a plurality of assembled pins, wherein the plug body has a transverse axis, a keyhole and a first through hole, each of the assembled pins at least comprises a first rack component and a second rack component in engagement with the first rack component, the position block has a second through hole corresponding to the first through hole and a tool-contacting surface located within the second through hole. Step 2 is to insert a first matched key into the keyhole of the plug body. Step 3 is to turn the first matched key to drive the plug body and the position block rotating. Step 4 is to insert a programming tool into the first through hole of the plug body and the second through hole of the position block. Step 5 is to turn the programming tool to push against the tool-contacting surface of the position block and make each of the first rack components move along the transverse axis-direction of the plug body to release engagement with each of the second rack components. Step 6 is to pull out the first matched key. Step 7 is to insert a second matched key into the keyhole of the plug body. Step 8 is to turn the programming tool to make each of first rack components reengage with each of the second rack components.

DETAILED DESCRIPTION OF THE INVENTION

Figure 1:
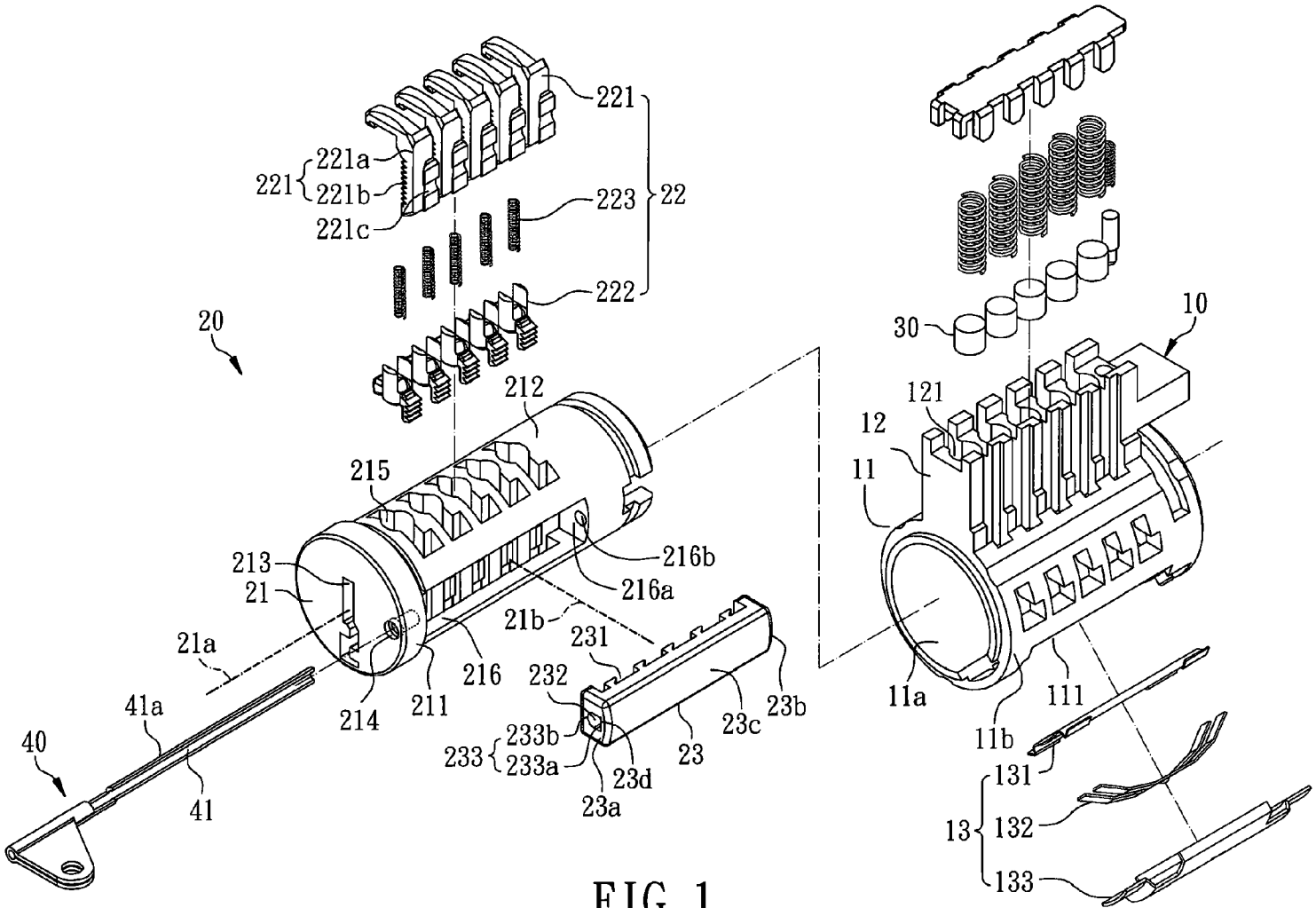
FIG. 1 is a perspective exploded view of a rekeyable lock cylinder according to the first preferred embodiment of the present invention.
Figure 2:
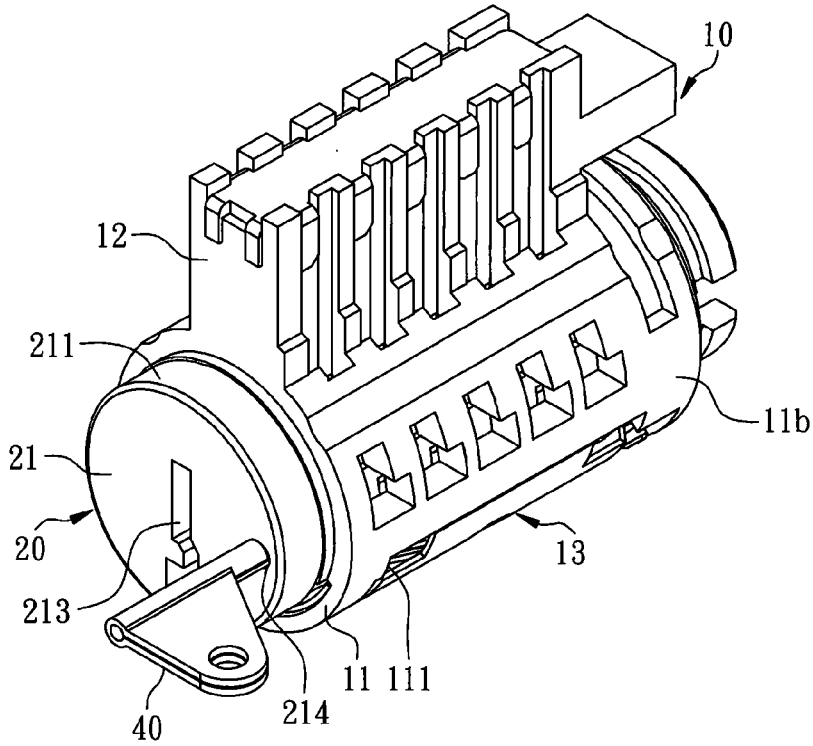
FIG. 2 is a perspective assembly view of the rekeyable lock cylinder.
Figure 4:
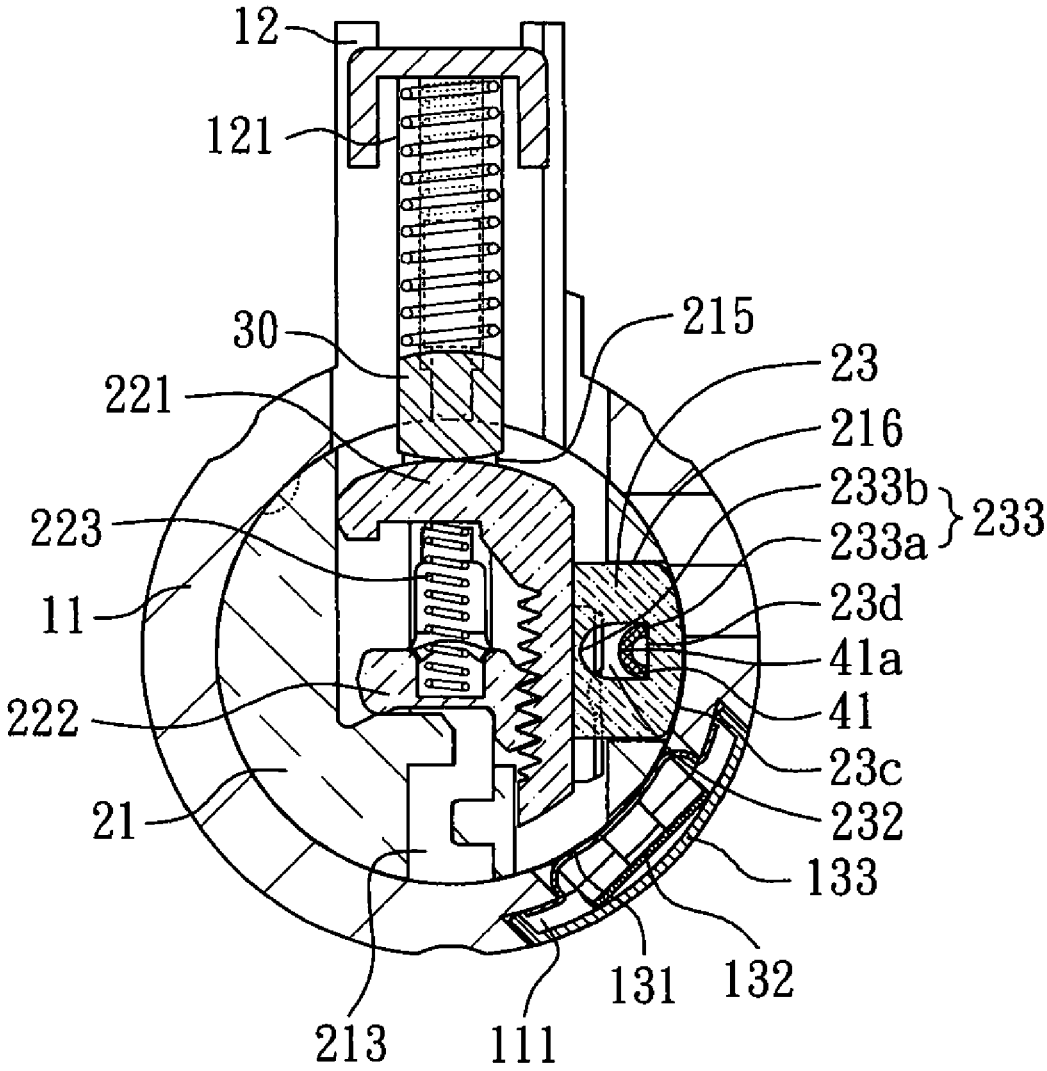
FIG. 4 is a longitudinal sectional assembly view of the rekeyable lock cylinder.

With reference to FIGS. 1 and 2, a rekeyable lock cylinder according to the first preferred embodiment of the present invention comprises a cylinder body 10, a plug assembly 20 disposed within the cylinder body 10 and a plurality of upper pins 30. The cylinder body 10 comprises a hollow cylinder portion 11 used for disposing the plug assembly 20, an extending protrusion 12 formed at one side of the hollow cylinder portion 11 and a biasing element 13 disposed at the hollow cylinder portion 11, however, the extending protrusion 12 can be omitted from the cylinder body 10 in another embodiment. In this embodiment, the hollow cylinder portion 11 has an inside wall 11*a*, an outside wall 11*b* and a recession 111 recessed from the inside wall 11*a*, wherein the recession 111 communicates with the inside wall 11*a* and the outside wall 11*b*. The extending protrusion 12 has a plurality of upper pin holes 121 in communication with the hollow cylinder portion 11. With reference to FIGS. 1, 2 and 4, the biasing element 13 disposed at the recession 111 of the hollow cylinder portion 11 comprises a movable plate 131 and at least one resilient member 132 contacting against the movable plate 131. In this embodiment, the movable plate 131 is transversely movable within the recession 111 and the biasing element 13 may further comprise an immovable plate 133 fixed at the recession 111. The resilient member 132 is disposed between the movable plate 131 and the immovable plate 133 and two ends of the resilient member 132 contact against the movable plate 131 and the immovable plate 133 respectively.

Figure 3:
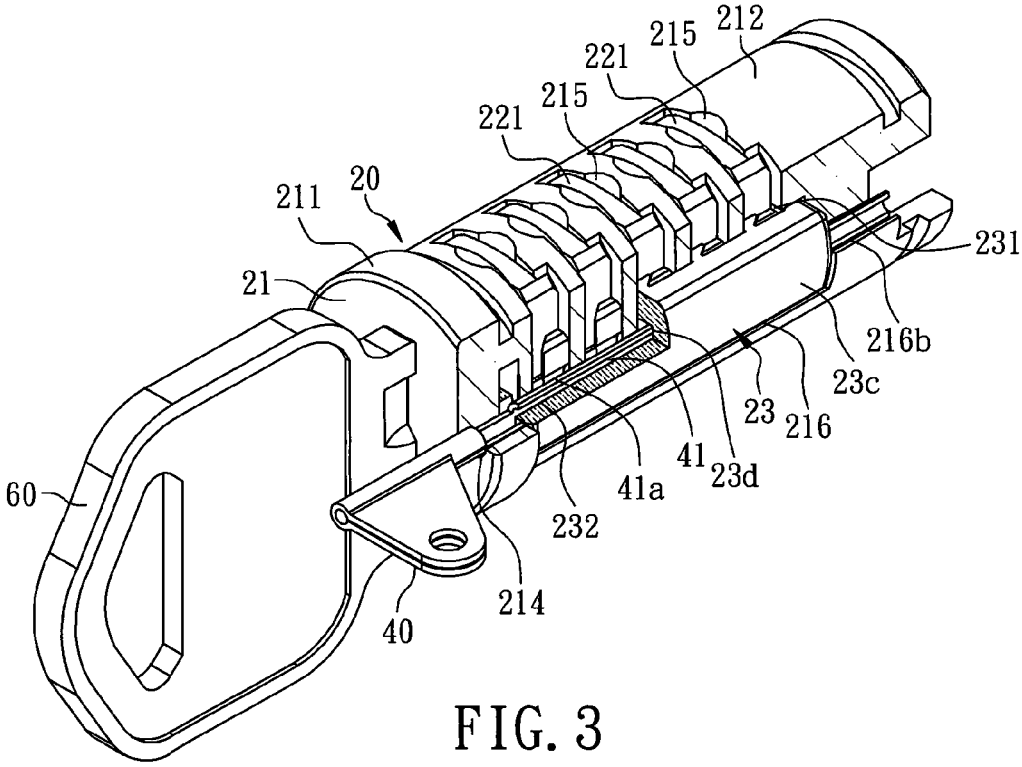
FIG. 3 is a partially broken away side view of a plug assembly according to the first preferred embodiment of the present invention.

With reference to FIGS. 1 and 3, the plug assembly 20 comprises a plug body 21, a plurality of assembled pins 22 and a position block 23. The plug body 21 has a longitudinal axis 21*a*, a transverse axis 21*b* vertical to the longitudinal axis 21*a*, a front portion 211, a rear portion 212, a keyhole 213 and a first through hole 214 penetrating the front portion 211. The rear portion 212 has a plurality of pin holes 215 used for disposing the assembled pins 22 and a trench 216 in communication with the pin holes 215. The trench 216 has a trench wall 216*a* facing the first through hole 214 and a tool-fixing hole 216*b* recessed from the trench wall 216*a*, and the tool-fixing hole 216*b* is desirable to correspond to the first through hole 214. Besides, the first through hole 214 communicates with the trench 216. With reference again to FIGS. 1, 3 and 4, the assembled pins 22 are movably disposed in the pin holes 215 of the plug body 21. In this embodiment, the assembled pins 22 are height-adjustable pins and each of them comprises a first rack component 221, a second rack component 222 selectively engaging with the first rack component 221 and an elastic component 223 disposed between the first and second rack components 221, 222. Each of the first rack components 221 has a rib 221*a* and a rack portion 221*b* formed at the rib 221*a* and each of the ribs 221*a* has an accommodating slot 221*c*. With reference again to FIGS. 1, 3 and 4, the position block 23 disposed at the trench 216 of the rear portion 212 of the plug body 21 has a first side 23*a* facing the first through hole 214, a second side 23*b* opposite to the first side 23*a*, an outside wall 23*c*, a plurality of pin runners 231 used for disposing the first rack components 221, a second through hole 232 corresponding to the first through hole 214 and a tool-contacting surface 23*d* located within the second through hole 232. The second through hole 232 communicates with the first and second sides 23*a*, 23*b*, and also with the pin runners 231. Besides, there is a hole wall 233 within the second through hole 232, the hole wall 233 has a first wall 233*a* facing the first rack components 221 and a second wall 233*b* opposite to the first wall 233*a*. The tool-contacting surface 23*d* is desirable to be the first wall 233*a*. With reference again to FIGS. 1, 3 and 4, the upper pins 30 are movably disposed at least one upper pin hole 121 of the extending protrusion 12 of the cylinder body 10 and at least one pin hole 215 of the rear portion 212 of the plug body 21. Each of the upper pins 30 contacts against each of the first rack components 221.

With reference again to FIGS. 1, 3 and 4, when the rekeyable lock cylinder of the present invention is rekeyed, it needs to use a programming tool 40 for disengaging and reengaging the first and second rack components 221, 222. The programming tool 40 will penetrate the first through hole 214 of the plug body 21 and the second through hole 232 of the position block 23 when applied to rekey and has a contacting portion 41 which can push against the position block 23 and make each of the first rack components 221 move along the transverse axis 21*b*-direction of the plug body 21 to release engagement with each of the second rack components 222. The contacting portion 41 has an arc side wall 41*a* which may contact against the tool-contacting surface 23*d* of the position block 23.

Figure 5:
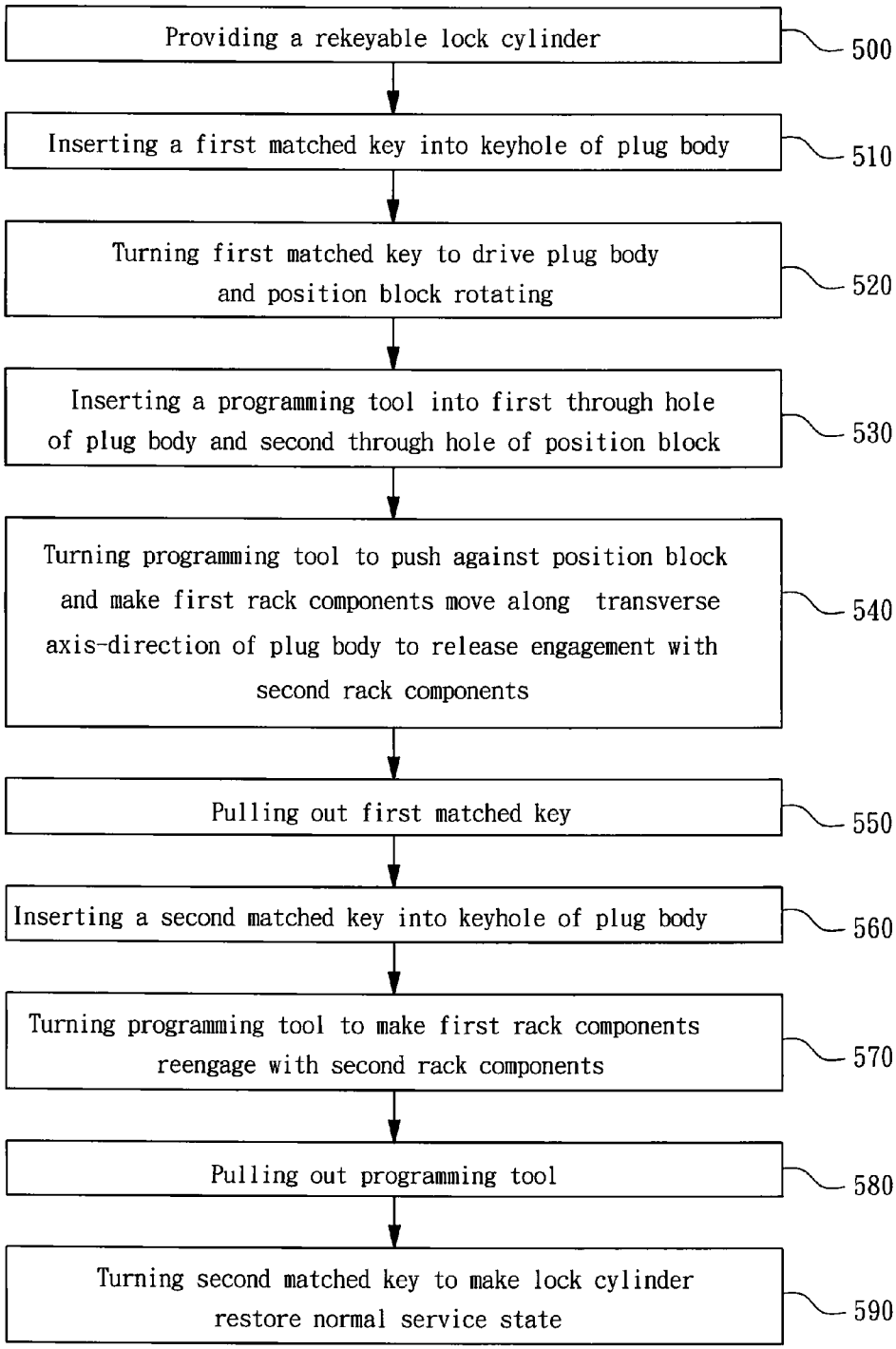
FIG. 5 is an operating flow chart of the rekeyable lock cylinder.
Figure 6:
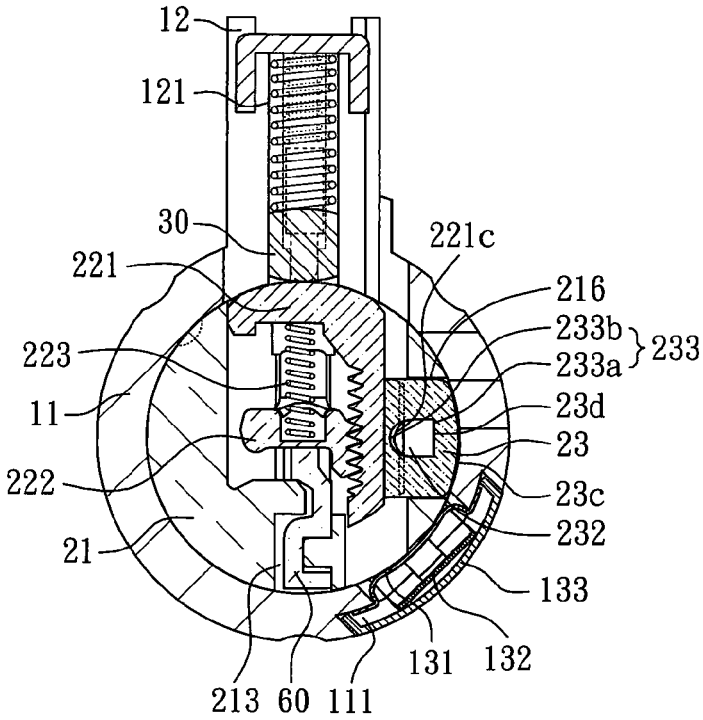
FIG. 6 is a longitudinal sectional view illustrating the state of inserting the first matched key into the rekeyable lock cylinder according to the first preferred embodiment of the present invention.
Figure 7:
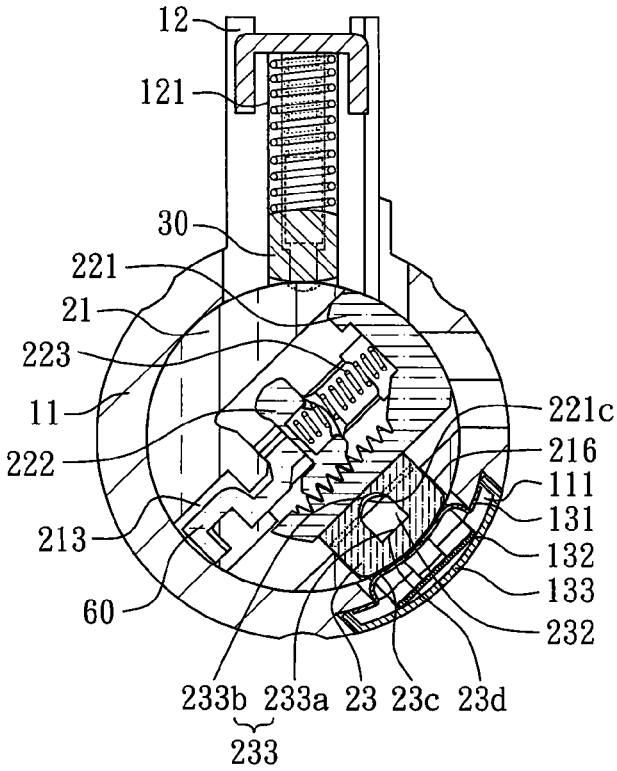
FIG. 7 is a longitudinal sectional view illustrating the state of turning the first matched key 45-degrees clockwise according to the first preferred embodiment of the present invention.
Figure 8:
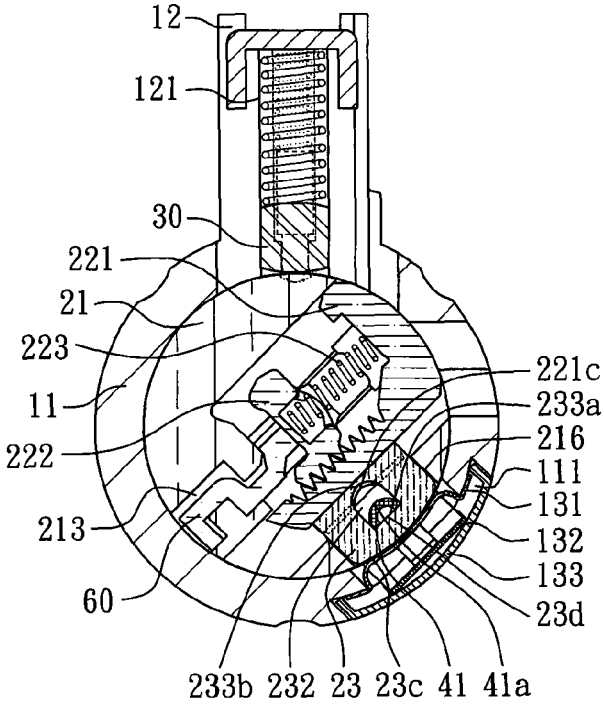
FIG. 8 is a longitudinal sectional view illustrating the state of inserting a programming tool according to the first preferred embodiment of the present invention.
Figure 9:
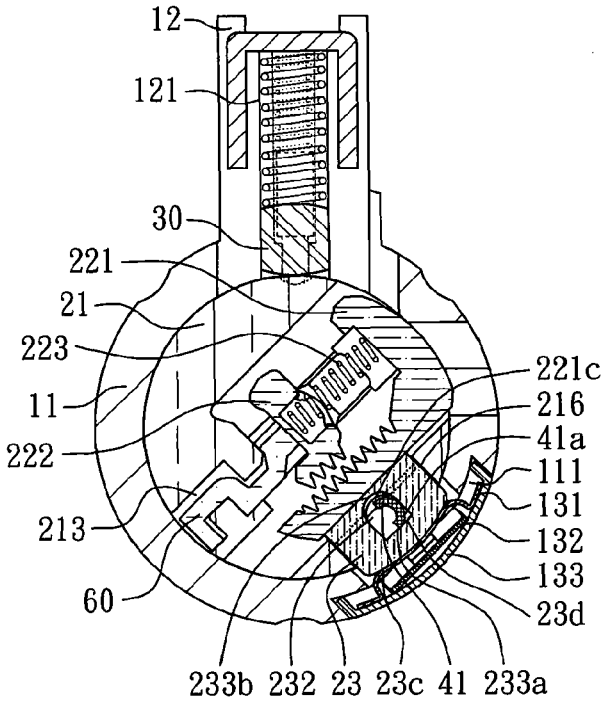
FIG. 9 is a longitudinal sectional view illustrating the state of turning the programming tool 90-degrees clockwise according to the first preferred embodiment of the present invention.
Figure 10:
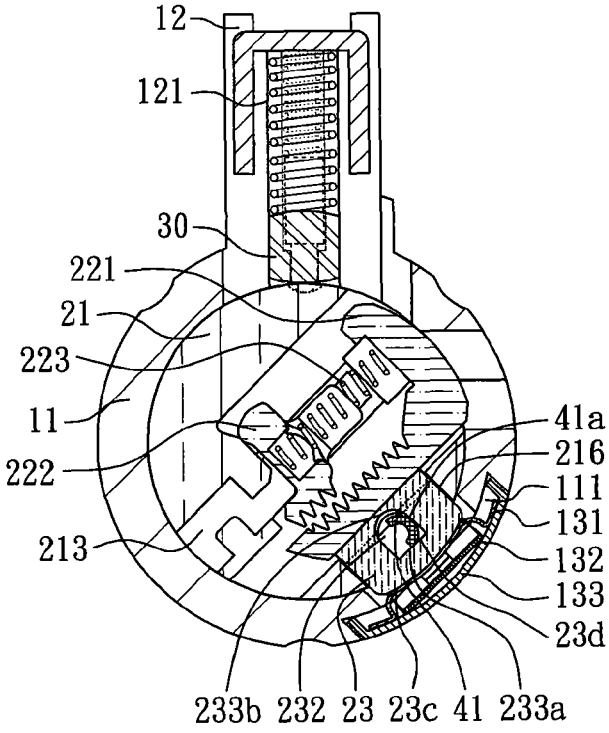
FIG. 10 is a longitudinal sectional view illustrating the state of pulling out the first matched key according to the first preferred embodiment of the present invention.
Figure 11:
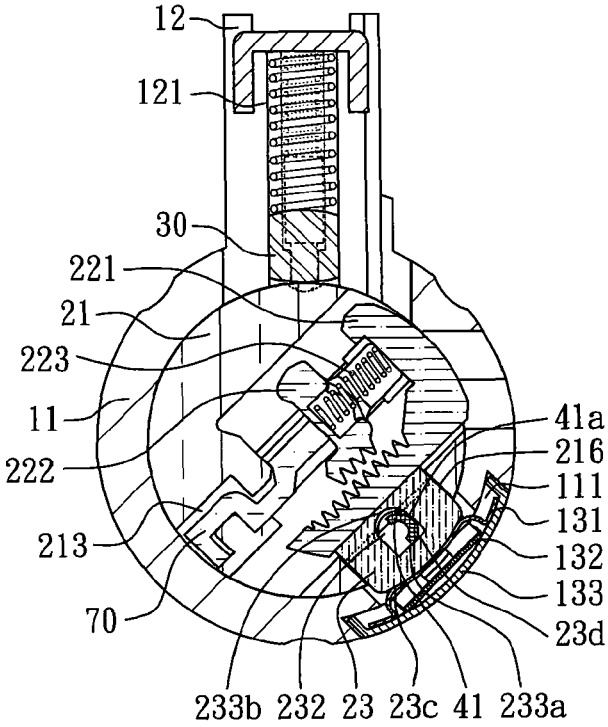
FIG. 11 is a longitudinal sectional view illustrating the state of inserting the second matched key into the rekeyable lock cylinder according to the first preferred embodiment of the present invention.
Figure 12:
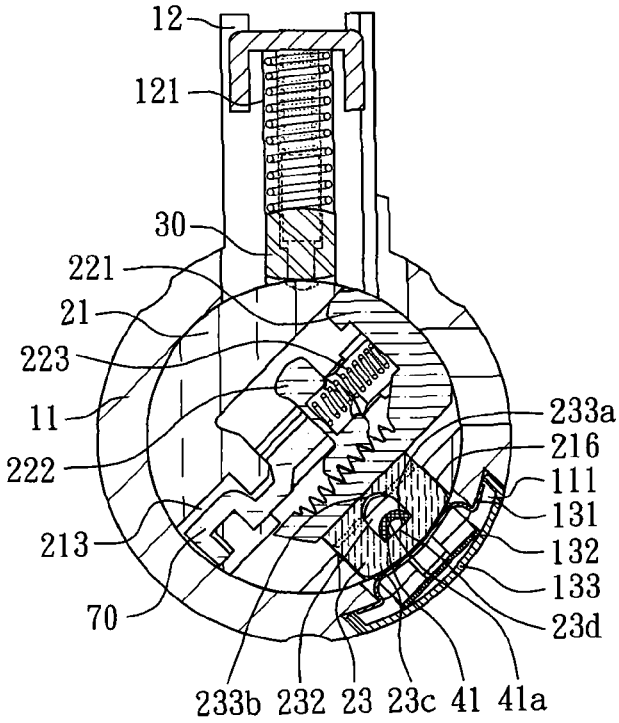
FIG. 12 is a longitudinal sectional view illustrating the state of turning the programming tool 90-degrees counter-clockwise according to the first preferred embodiment of the present invention.
Figure 13:
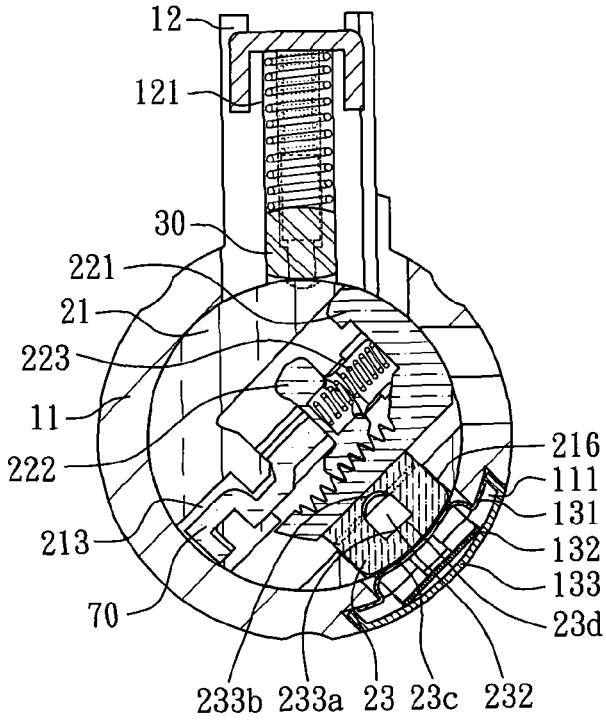
FIG. 13 is a longitudinal sectional view illustrating the state of pulling out the programming tool according to the first preferred embodiment of the present invention.
Figure 14:
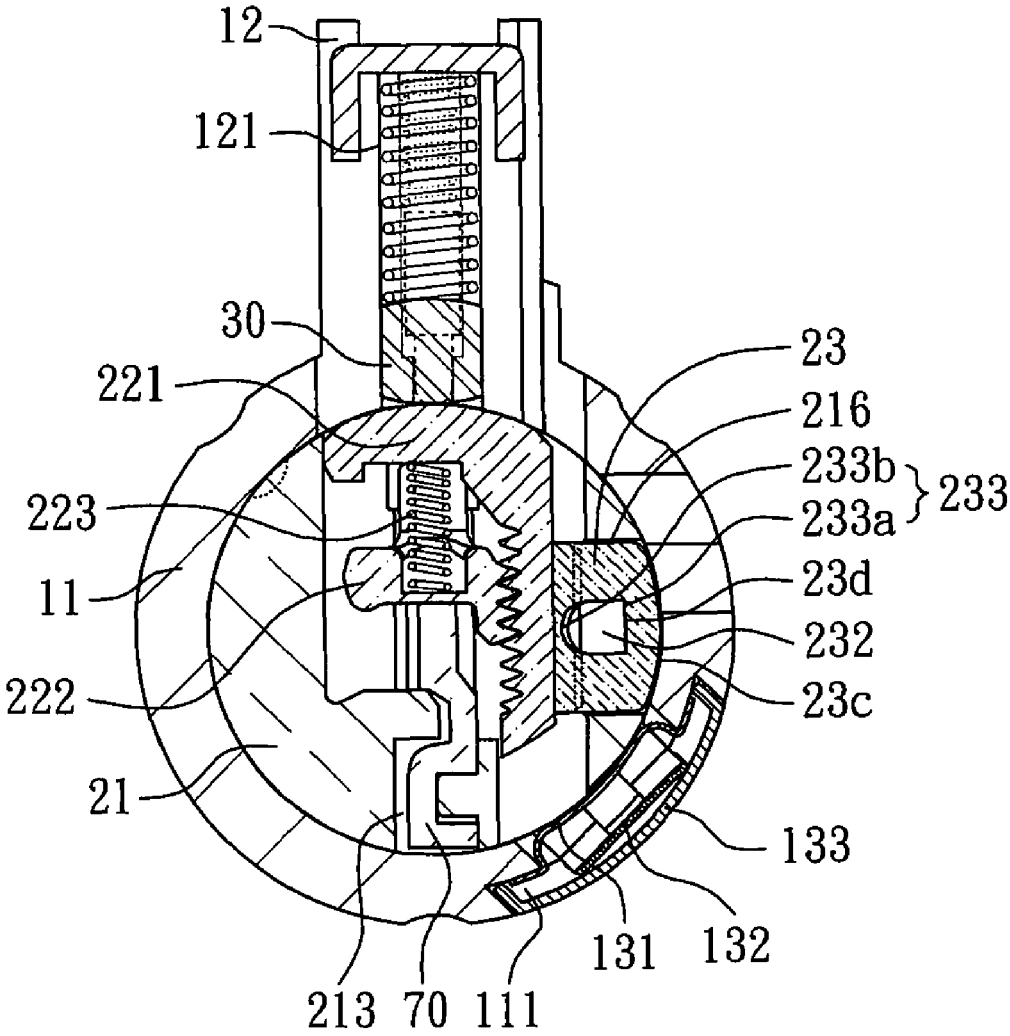
FIG. 14 is a longitudinal sectional view illustrating that the rekeyable lock cylinder is in normal service state according to the first preferred embodiment of the present invention.

FIG. 5 illustrates operating method of the rekeyable lock cylinder comprising "providing a rekeyable lock cylinder" step 500, "inserting a first matched key into keyhole of plug body" step 510, "turning first matched key to drive plug body and position block rotating" step 520, "inserting a programming tool into first through hole of plug body and second through hole of position block" step 530, "turning programming tool to push against position block and make first rack components move along transverse axis-direction of plug body to release engagement with second rack components" step 540, "pulling out first matched key" step 550, "inserting a second matched key into keyhole of plug body" step 560, "turning programming tool to make first rack components reengage with second rack components" step 570, "pulling out programming tool" step 580 and "turning second matched key to make lock cylinder restore normal service state" step 590. First, with reference to step 500 of FIG. 5, FIGS. 2 and 4, the rekeyable lock cylinder is formed by assembling the cylinder body 10, the plug assembly 20 and the upper pins 30 during "providing a rekeyable lock cylinder" step 500, wherein the first rack components 221 are in engagement with the second rack components 222 within the rekeyable lock cylinder. Next, with reference to step 510 of FIG. 5 and FIG. 6, a first matched key 60 is inserted into the keyhole 213 of the plug body 21 during "inserting a first matched key into keyhole of plug body" step 510, wherein the first matched key 60 will push against the assembled pins 22 to move upward to rotating interface, the accommodating slots 221*c* of the ribs 221*a* of the first rack components 221 are in alignment. Next, with reference to step 520 of FIG. 5 and FIG. 6, the first matched key 60 is turned to drive the plug body 21 and the position block 23 rotating to a predetermined angular position during "turning first matched key to drive plug body and position block rotating" step 520, wherein the first matched key 60 is turned 45-degrees clockwise, the position block 23 corresponds to the recession 111 of the hollow cylinder portion 11 and the biasing element 13 and also contacts against the movable plate 131 of the biasing element 13. Next, with reference to step 530 of FIG. 5 and FIG. 8, a programming tool 40 is inserted into the first through hole 214 of the plug body 21 and the second through hole 232 of the position block 23 during "inserting a programming tool into first through hole of plug body and second through hole of position block" step 530, wherein the contacting portion 41 of the programming tool 40 corresponds to each of the accommodating slots 221*c* of the ribs 221*a* of the first rack components 221. Next, with reference to step 540 of FIG. 5 and FIG. 9, the programming tool 40 is turned to make the contacting portion 41 push against the tool-contacting surface 23*d* of the position block 23 and drive the position block 23 to move along the transverse axis 21*b*-direction of the plug body 21 during "turning programming tool to push against position block and make first rack components move along transverse axis-direction of plug body to release engagement with second rack components" step 540, wherein the programming tool 40 is turned 90-degrees clockwise, the arc side wall 41*a* of the contacting portion 41 contacts and pushes against the tool-contacting surface 23*d*, the movable plate 131 of the biasing element 13 is pushed by the position block 23 to move toward the immovable plate 133 and compress the resilient member 132, and when the position block 23 moves, it will drive each of the first rack components 221 to move along the transverse axis 21*b*-direction of the plug body 21, thereby releasing engagement with each of the second rack components 222. Next, with reference to step 550 of FIG. 5 and FIG. 10, the first matched key 60 is pulled out during "pulling out first matched key" step 550, wherein the second rack components 222 of the assembled pins 22 are pushed by the elastic components 223 to fall down to lowermost position. Next, with reference to step 560 of FIG. 5 and FIG. 11, a second matched key 70 is inserted into the keyhole 213 of the plug body 21 during "inserting a second matched key into keyhole of plug body" step 560, wherein the second rack components 222 of the assembled pins 22 readjust height according to bitting of the second matched key 70 with different height. Next, with reference to step 570 of FIG. 5 and FIG. 12, the programming tool 40 is turned to make the first rack components 221 reengage with the second rack components 222 during "turning programming tool to make first rack components reengage with second rack components" step 570, wherein the programming tool 40 is turned 90-degrees counterclockwise, the arc side wall 41*a* of the contacting portion 41 moves away from the tool-contacting surface 23*d*, the position block 23 is pushed by the resilient member 132 of the biasing element 13 to restore and drive each of the first rack components 221 to reengage with each of the second rack components 222. Next, with reference to step 580 of FIG. 5 and FIG. 13, the programming tool 40 is pulled out during "pulling out programming tool" step 580. Finally, with reference to step 590 of FIG. 5 and FIG. 14, the second matched key 70 is turned to make the rekeyable lock cylinder restore normal service state during "turning second matched key to make lock cylinder restore normal service state" step 590.

The programming tool 40 according to the present invention can contact against the tool-contacting surface 23*d* of the position block 23 during turning process to push against the position block 23 and drive the first rack components 221 releasing engagement with the second rack components. On the contrary, if the programming tool 40 cannot contact against the tool-contacting surface 23*d* during turning process, the position block 23 cannot be moved and cannot rekey, therefore, the present invent has efficiency of enhancing burglarproof of the rekeyable lock cylinder.

Figure 15:
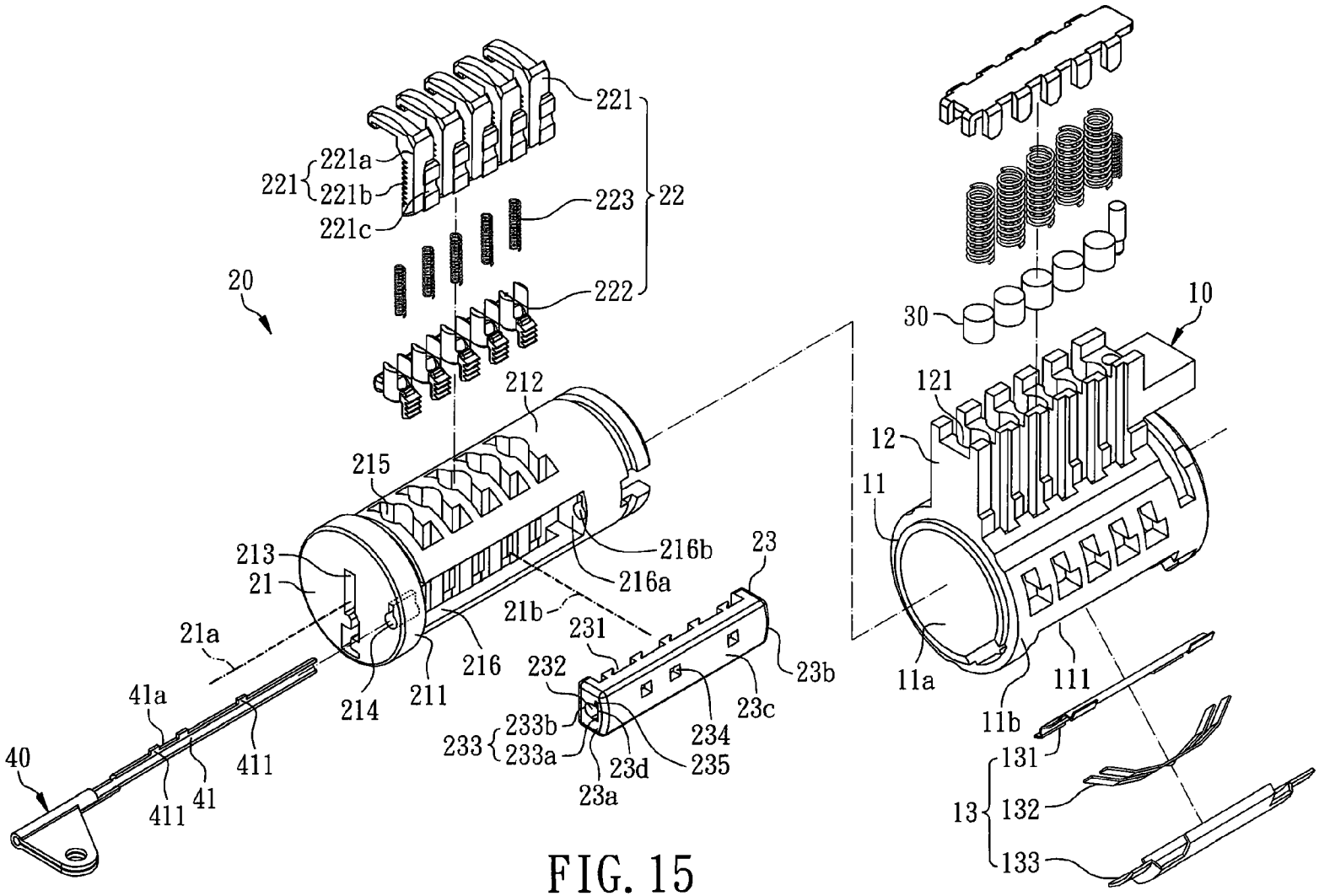
FIG. 15 is a perspective exploded view of a rekeyable lock cylinder according to the second preferred embodiment of the present invention.
Figure 16:
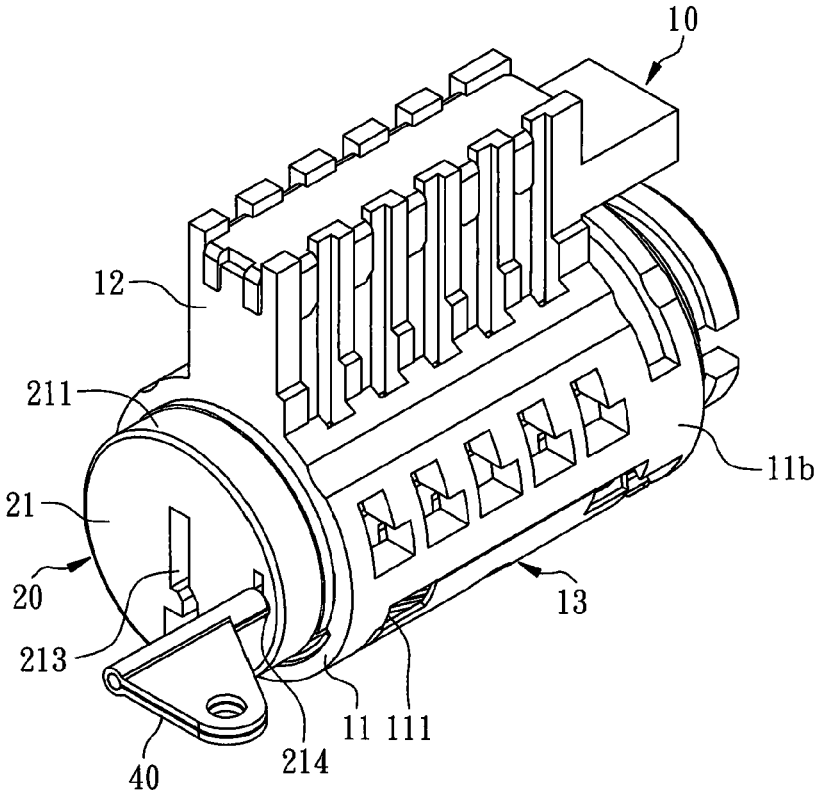
FIG. 16 is a perspective assembly view of the rekeyable lock cylinder according to the second preferred embodiment of the present invention.
Figure 17:
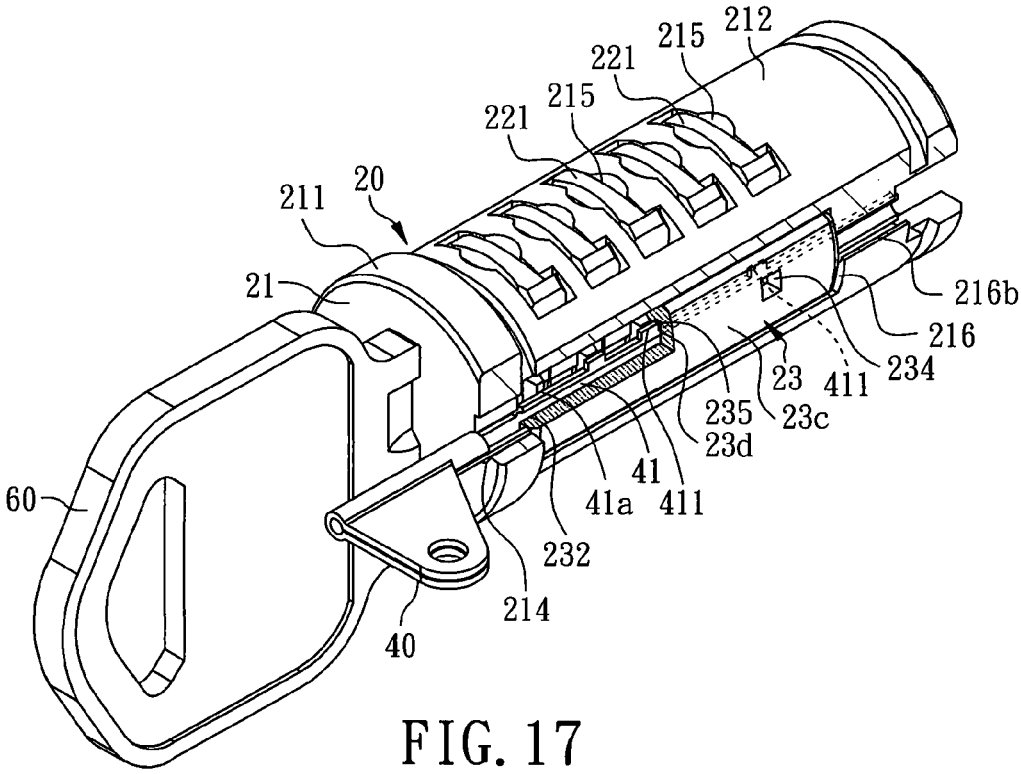
FIG. 17 is a partially broken away side view of a plug assembly according to the second preferred embodiment of the present invention.
Figure 18:
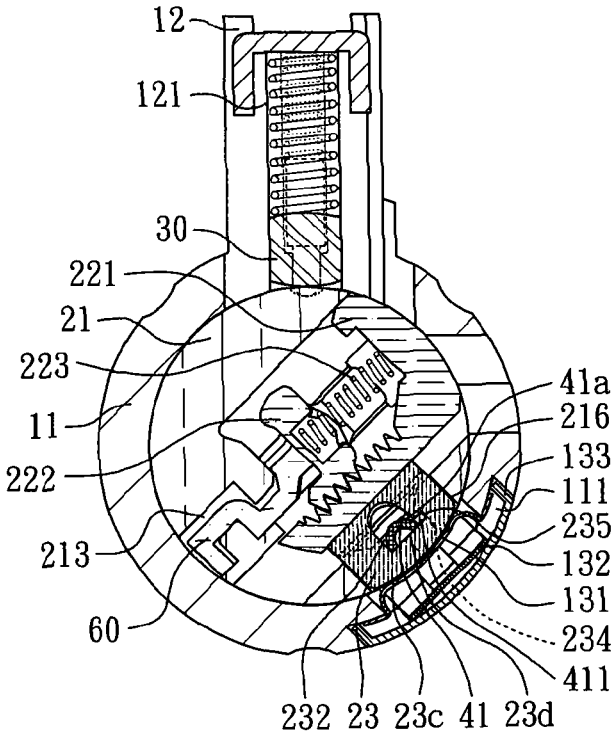
FIG. 18 is a longitudinal sectional view illustrating the state of inserting the programming tool according to the second preferred embodiment of the present invention.
Figure 19:
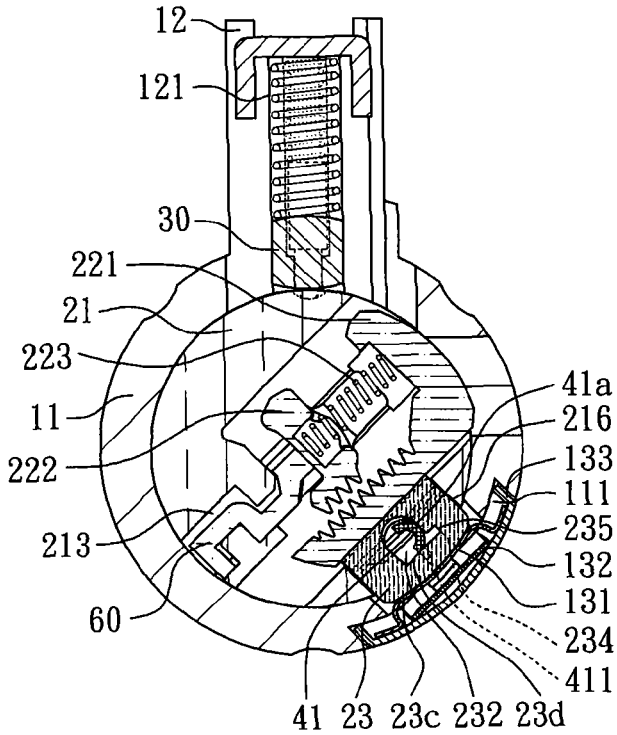
FIG. 19 is a longitudinal sectional view illustrating the state of turning the programming tool clockwise according to the second preferred embodiment of the present invention.

With reference to FIGS. 15, 16 and 17, which illustrates a rekeyable lock cylinder according to the second preferred embodiment of the present invention, the structural characteristic in this embodiment is basically the same as that in the first preferred embodiment, but the only difference is that the position block 23 further has at least one tool-aligning hole 234 and a limiting slot 235 in communication with the second through hole 232 as well as the contacting portion 41 of the programming tool 40 further has at least one limiting block 411 in order to surely enhance burglarproof of lock cylinder in this embodiment. The tool-aligning hole 234 of the position block 23 communicates with the outside wall 23*c* and the tool-contacting surface 23*d*. The programming tool 40 having the limiting block 411 can be regarded as a dedicated key. Moreover, with reference to FIG. 18, operating method of this embodiment is also basically the same as that in the first preferred embodiment, but the only difference is that the programming tool 40 can be turned after it is inserted into the first through hole 214 of the plug body 21 and the second through hole 232 of the position block 23 only if the limiting block 411 of the contacting portion 41 corresponds to the tool-aligning hole 234 of the position block 23. The limiting block 411 of the contacting portion 41 will be limited by the limiting slot 235 if it does not correspond to the tool-aligning hole 234 of the position block 23, which makes the programming tool 40 be unable to rotate thereby enhancing burglarproof of lock cylinder. Besides, with reference to FIG. 19, the programming tool 40 is turned to make the contacting portion 41 push against the tool-contacting surface 23*d* of the position block 23 and drive the position block 23 to move along the transverse axis 21*b*-direction of the plug body 21, which makes the first rack components 221 release engagement with the second rack components 222. In this embodiment, the tool-aligning hole 234 of the position block 23 provides a space needed for rotation of the limiting block 411 of the programming tool 40 to prevent the limiting block 411 from being caught by the limiting slot 235 resulting in that the programming tool 40 is unable to rotate.

Figure 20:
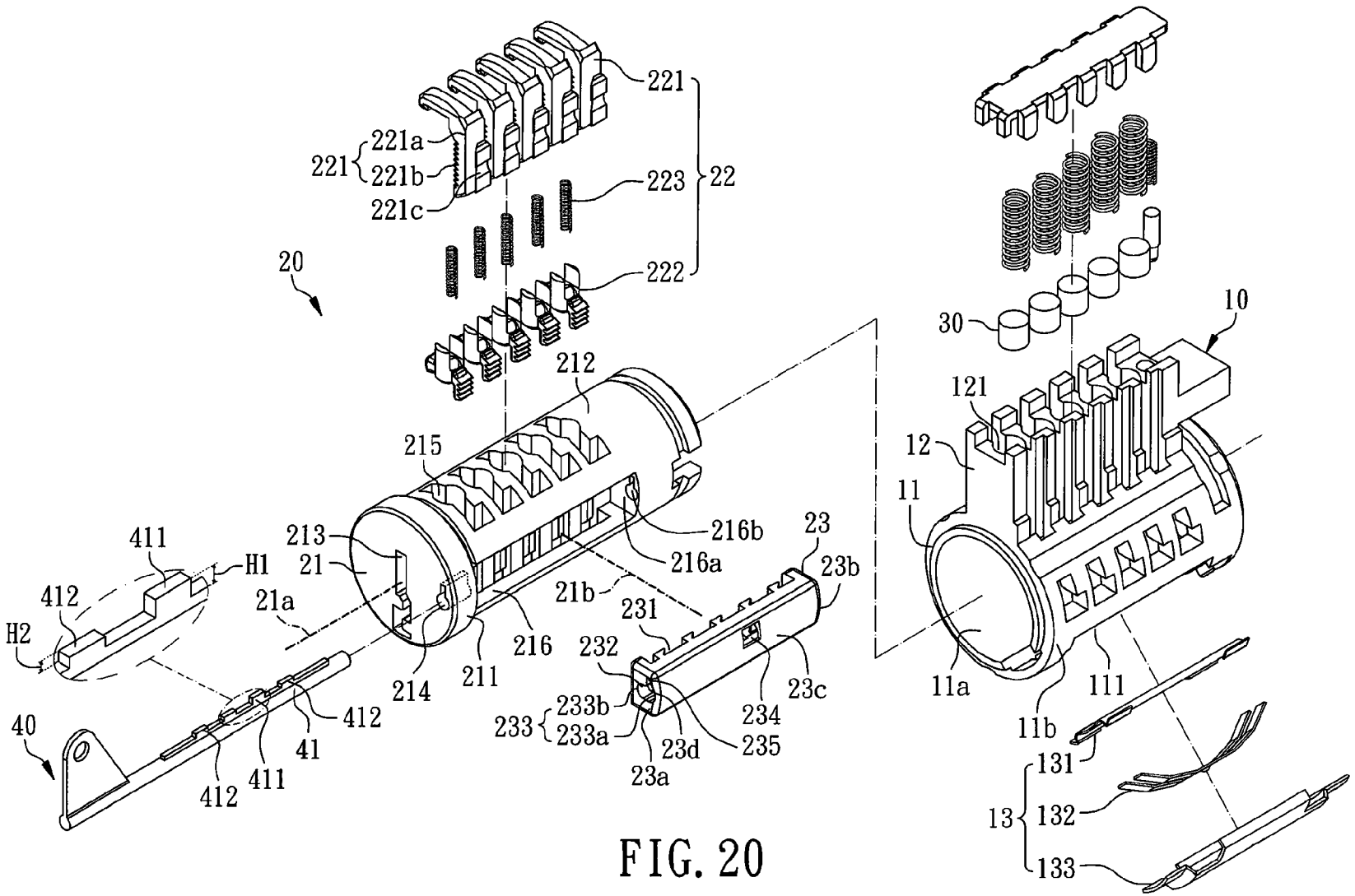
FIG. 20 is a perspective exploded view of a rekeyable lock cylinder according to the third preferred embodiment of the present invention.
Figure 21:
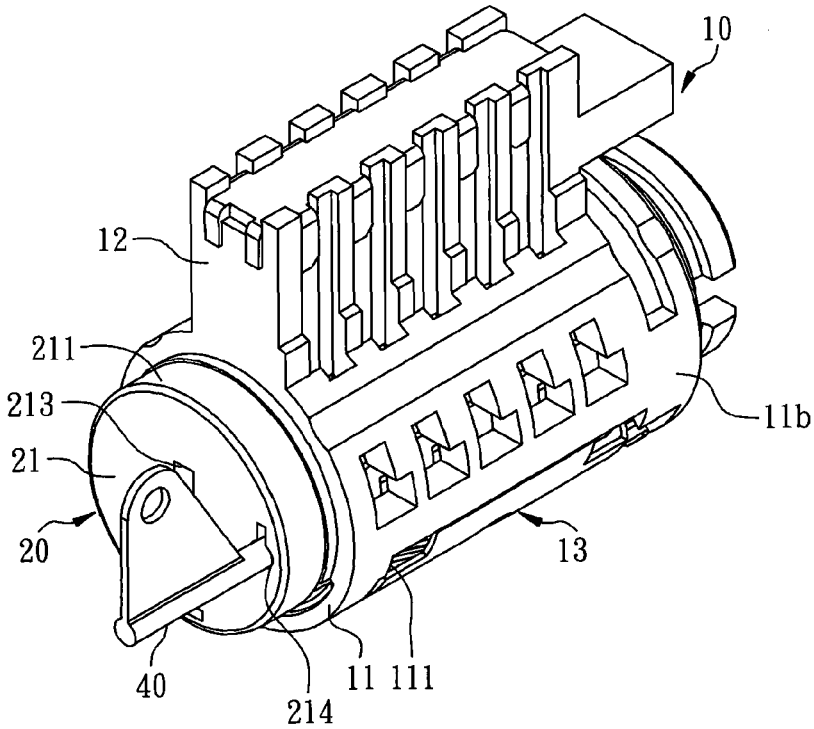
FIG. 21 is a perspective assembly view of the rekeyable lock cylinder according to the third preferred embodiment of the present invention.
Figure 22:
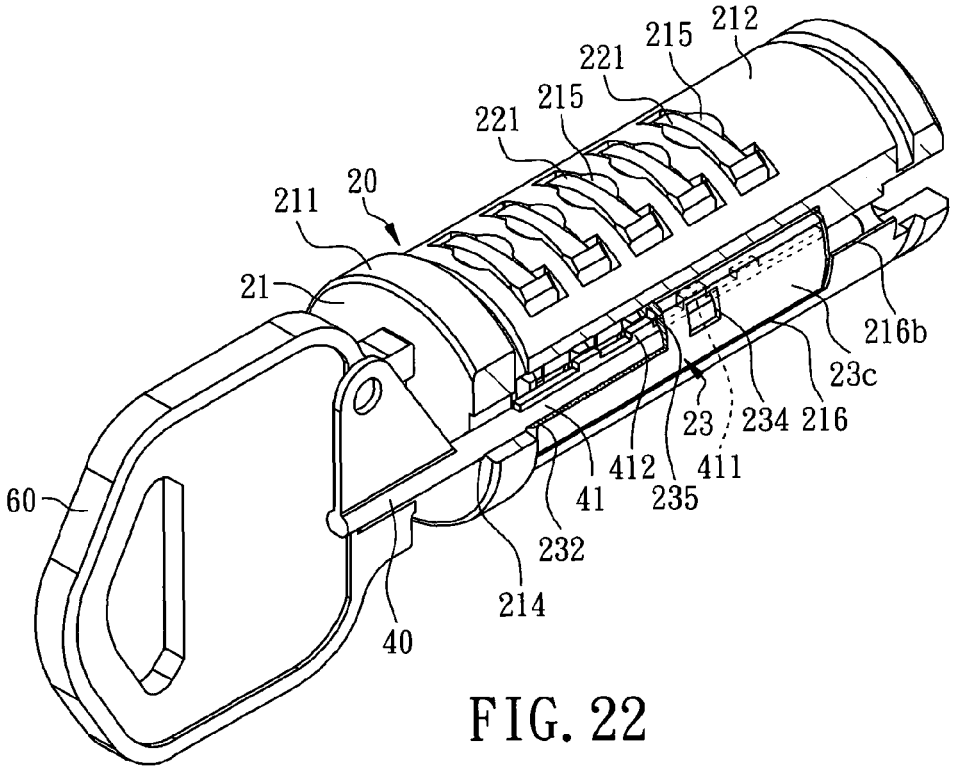
FIG. 22 is a partially broken away side view of a plug assembly according to the third preferred embodiment of the present invention.
Figure 23:
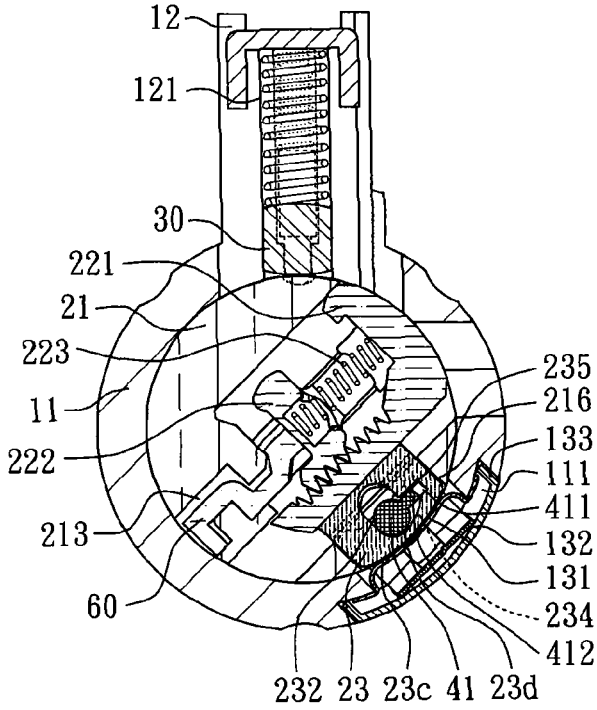
FIG. 23 is a longitudinal sectional view illustrating the state of inserting the programming tool according to the third preferred embodiment of the present invention.
Figure 24:
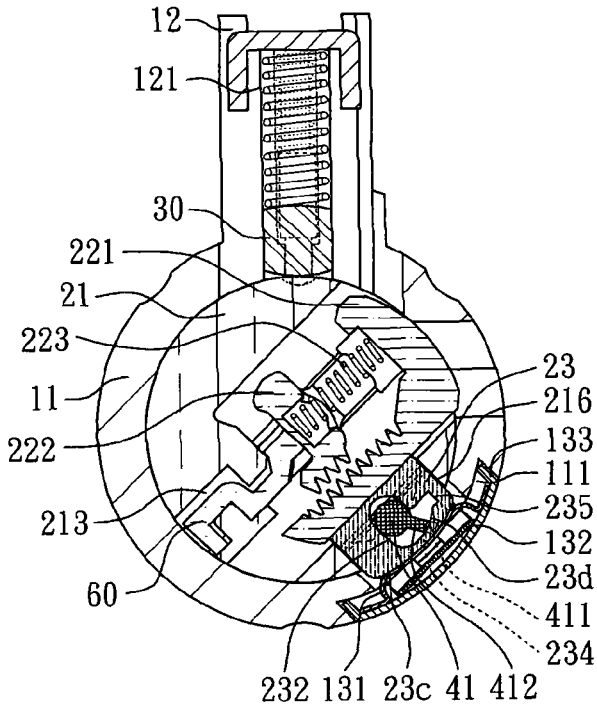
FIG. 24 is a longitudinal sectional view illustrating the state of turning the programming tool clockwise according to the third preferred embodiment of the present invention.

With reference to FIGS. 20, 21 and 22, which illustrates a rekeyable lock cylinder according to the third preferred embodiment of the present invention, the structural characteristic in this embodiment is basically the same as that in the second preferred embodiment, but the only difference is that the contacting portion 41 of the programming tool 40 further has at least one pushing block 412 which is able to contact against the tool-contacting surface 23*d* of the position block 23 in this embodiment. The limiting block 411 of the contacting portion 41 has a first height H1, the pushing block 412 has a second height H2, and preferably the first height H1 of the limiting block 411 is higher than the second height H2 of the pushing block 412. Besides, the programming tool 40 having the limiting block 411 and the pushing block 412 also can be regarded as a dedicated key. In addition, with reference to FIG. 23, operating method of this embodiment is also basically the same as that in the second preferred embodiment, the programming tool 40 can be turned after it is inserted into the first through hole 214 of the plug body 21 and the second through hole 232 of the position block 23 only if the limiting block 411 of the contacting portion 41 corresponds to the tool-aligning hole 234 of the position block 23. With reference to FIG. 24, the only difference of operating method between the second and third embodiments is that when turning the programming tool 40, the pushing block 412 of the contacting portion 41 pushes against the tool-contacting surface 23*d* of the position block 23 in this embodiment to drive the position block 23 moving along the transverse axis 21*b*-direction of the plug body 21, which makes the first rack components 221 release engagement with the second rack components 222.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A rekeyable lock cylinder comprising:

a cylinder body; and a plug assembly disposed within the cylinder body comprising:

a plug body having a longitudinal axis, a transverse axis vertical to the longitudinal axis, a keyhole and a first through hole;

a plurality of assembled pins movably disposed in the plug body, each of the assembled pins comprising a first rack component and a second rack component selectively engaging with the first rack component; and a position block disposed at the plug body, the position block having a plurality of pin runners used for disposing the first rack components, a second through hole corresponding to the first through hole and a tool-contacting surface located within the second through hole, wherein the position block can move along the transverse axis-direction of the plug body to make each of the first rack components release engagement with each of the second rack components, wherein the position block has an outside wall and at least one tool-aligning hole, the tool-aligning hole communicates with the outside wall and the tool-contacting surface.

2. The rekeyable lock cylinder in accordance with claim 1, wherein the plug body has a front portion and a rear portion, the rear portion has a plurality of pin holes used for disposing the assembled pins and a trench in communication with the pin holes, the position block is disposed at the trench, the first through hole penetrates the front portion and communicates with the trench.

3. The rekeyable lock cylinder in accordance with claim 1, wherein the cylinder body comprises a hollow cylinder portion used for disposing the plug assembly and a biasing element, the hollow cylinder portion has an inside wall and a recession recessed from the inside wall, the biasing element is disposed at the recession.

4. The rekeyable lock cylinder in accordance with claim 3, wherein the biasing element comprises a movable plate capable of being pushed by the position block and at least one resilient member contacting against the movable plate.

5. The rekeyable lock cylinder in accordance with claim 1, further comprising a plurality of upper pins, each of the upper pins contacting against each of the first rack components.

6. A rekeyable lock cylinder comprising:

a cylinder body;

a plug assembly disposed within the cylinder body comprising:

a plug body having a longitudinal axis, a transverse axis vertical to the longitudinal axis, a keyhole and a first through hole;

a plurality of assembled pins movably disposed in the plug body, each of the assembled pins comprising a first rack component and a second rack component selectively engaging with the first rack component; and a position block disposed at the plug body, the position block having a plurality of pin runners used for disposing the first rack components, a second through hole corresponding to the first through hole and a tool-contacting surface located within the second through hole; and a programming tool disposed penetrating the first and second through holes and having a contacting portion, wherein the contacting portion can push against the tool-contacting surface of the position block and make each of the first rack components move along the transverse axis-direction of the plug body to release engagement with each of the second rack components, wherein the contacting portion of the programming tool has at least one limiting block, the position block has at least one tool-aligning hole, the limiting block of the contacting portion corresponds to the tool-aligning hole of the position block.

7. The rekeyable lock cylinder in accordance with claim 6, wherein the contacting portion of the programming tool further has at least one pushing block, the pushing block contacts against the tool-contacting surface.

8. The rekeyable lock cylinder in accordance with claim 7, wherein the limiting block of the contacting portion has a first height, the pushing block has a second height, the first height is higher than the second height.

9. The rekeyable lock cylinder in accordance with claim 6, wherein the position block has an outside wall, the tool-aligning hole communicates with the outside wall and the tool-contacting surface.

10. The rekeyable lock cylinder in accordance with claim 6, wherein the cylinder body comprises a hollow cylinder portion used for disposing the plug assembly and a biasing element, the hollow cylinder portion has an inside wall and a recession recessed from the inside wall, the biasing element is disposed at the recession.

11. The rekeyable lock cylinder in accordance with claim 10, wherein the biasing element comprises a movable plate capable of being pushed by the position block and at least one resilient member contacting against the movable plate.

12. The rekeyable lock cylinder in accordance with claim 6, further comprising a plurality of upper pins, each of the upper pins contacting against each of the first rack components.

13. Operating method of a rekeyable lock cylinder comprising the steps of:

providing a rekeyable lock cylinder, wherein the rekeyable lock cylinder at least comprises a plug body, a position block disposed at the plug body and a plurality of assembled pins, the plug body has a transverse axis, a keyhole and a first through hole, each of the assembled pins at least comprises a first rack component and a second rack component in engagement with the first rack component, the position block has a second through hole corresponding to the first through hole and a tool-contacting surface located within the second through hole;

inserting a first matched key into the keyhole of the plug body;

turning the first matched key;

inserting a programming tool into the first through hole of the plug body and the second through hole of the position block;

turning the programming tool to push against the tool-contacting surface of the position block and make each of the first rack components move along the transverse axis-direction of the plug body to release engagement with each of the second rack components;

pulling out the first matched key;

inserting a second matched key into the keyhole of the plug body; and turning the programming tool to make each of the first rack components reengage with each of the second rack components, wherein the programming tool has a contacting portion, the contacting portion has at least one limiting block, the position block has at least one tool-aligning hole, the limiting block of the contacting portion corresponds to the tool-aligning hole of the position block.

14. The operating method of the rekeyable lock cylinder in accordance with claim 13, further comprising a step of pulling out the programming tool, the rekeyable lock cylinder further comprising a biasing element to make the position block restore after pulling out the programming tool.

15. The operating method of the rekeyable lock cylinder in accordance with claim 14, wherein the biasing element comprises a movable plate capable of being pushed by the position block and at least one resilient member contacting against the movable plate.

16. The operating method of the rekeyable lock cylinder in accordance with claim 13, wherein there is a hole wall within the second through hole of the position block, the hole wall has a first wall facing the first rack components and a second wall opposite to the first wall, the tool-contacting surface is the first wall.

17. The operating method of the rekeyable lock cylinder in accordance with claim 13, wherein the rekeyable lock cylinder further comprises a plurality of upper pins, each of the upper pins contacts against each of the first rack components.

* * * * *